United States Patent [19]

Krumm

[11] Patent Number: 5,069,395

[45] Date of Patent: Dec. 3, 1991

[54] METHOD FOR DELIVERING THREAD TO A THREAD USER AND APPARATUS FOR PERFORMING THE METHOD

[75] Inventor: Valentin Krumm, Hergensweiler, Fed. Rep. of Germany

[73] Assignee: Lindauer Dornier Gesellschaft m.b.H., Fed. Rep. of Germany

[21] Appl. No.: 522,231

[22] Filed: May 11, 1990

[30] Foreign Application Priority Data

May 12, 1989 [DE] Fed. Rep. of Germany ..... 3915491

[51] Int. Cl.[5] ..... B65H 51/20; B65H 49/18

[52] U.S. Cl. ..... 242/47.01; 242/54 R; 242/128; 139/452

[58] Field of Search ..... 242/47.01, 47.12, 128, 242/54 R, 1; 139/452

[56] References Cited

U.S. PATENT DOCUMENTS

| | | | |
|---|---|---|---|
| 2,574,455 | 11/1951 | Abbott | 242/128 X |
| 2,628,579 | 2/1953 | Sutphin | 242/128 X |
| 3,057,577 | 10/1962 | Ruhl | 242/128 |
| 3,411,548 | 11/1968 | Pfarrwaller | 242/47.01 X |

FOREIGN PATENT DOCUMENTS

| | | | |
|---|---|---|---|
| 1450896 | 7/1966 | France | 242/128 |
| 157526 | 9/1983 | Japan | 242/128 |
| 296987 | 7/1929 | United Kingdom | 242/128 |
| 693212 | 6/1953 | United Kingdom | 242/128 |
| 908781 | 10/1962 | United Kingdom | 242/128 |

*Primary Examiner*—Stanley N. Gilreath
*Attorney, Agent, or Firm*—W. G. Fasse

[57] ABSTRACT

A method and apparatus for delivering thread from a coiled thread supply to a thread user, is arranged and constructed to avoid twisting, snagging, and breaking of the thread, especially threads of the so-called "Lurex" ® type. For this purpose the supply spool is positively driven in response to a drive control which drives the spool in a direction of the original winding of the thread onto the spool, that is, opposite to the direction of the unwinding of the thread from the spool so that the take-off point where the thread separates from the winding on the spool, remains approximately stationary or even completely stationary due to the compensation of the tendency of the take-off point to travel in a direction opposite to the original winding direction. The take-off point remains able to travel axially back and forth along the spool.

16 Claims, 3 Drawing Sheets

CPU
MOTOR

METHOD FOR DELIVERING THREAD TO A THREAD USER AND APPARATUS FOR PERFORMING THE METHOD

FIELD OF THE INVENTION

The invention relates to a method for delivering thread to a thread user, such as a shuttleless loom. The invention also relates to an apparatus for performing the method. The present method and apparatus are particularly suitable for transporting a band, tape or strip type yarn, which has a flat, rectangular, rather than a round, cross-section. The yarn is pulled off a coiled yarn supply, such as a disk spool, for transport through a thread brake to the loom.

BACKGROUND INFORMATION

Band, tape, or strip type flat yarns are known, for example, in the form of unreinforced, so-called "Lurex" ® yarns having a rectangular cross-section. However, the invention is not limited to this type of yarns. Rather, yarns with a round cross-section having a twist or no twist at all can also be handled in accordance with the present teaching. Even highly twisted twines can be handled as taught herein.

The use of yarns of the above type, including highly twisted twines, in shuttleless looms has been subject to substantial difficulties in practice because, depending on the yarn characteristic, the take-off point of the yarn from the coiled yarn supply has a tendency to travel in an uncontrolled manner back and forth on the surface of the coiled yarn winding. Such undesirable travel or excursion of the take-off point from an ideal position or location, resulted in substantially reduced operational speeds of the loom, it caused more frequent thread breaking, and the resulting fabrics frequently had quality reducing characteristics. Particular difficulties have been encountered when using non-reinforced Lurex ® yarns on shuttleless looms because this type yarns is pulled off the coiled yarn supply in a so-called "overhead" fashion, namely over a flange of the flanged or disk spool holding the coiled yarn supply. Conventionally, the disk spool is stationary, and the yarn is pulled off over the flange so that there is a tendency of twisting the yarn as it is being pulled off. This twisting even increases as the supply on the disk spool decreases. Such a twisting under tension is undesirable because when the tension is released, the yarn has a tendency to form undesirable loops. In the course of the withdrawal of the yarn from the supply, the twisting accumulates to such an extent that even under tension, that is while the yarn is still being withdrawn, loops can be formed. These loops can get stuck in the first thread brake downstream of the disk spool, whereby even more tension is applied to the thread. The increased tension in turn can either cause a permanent stretching of the thread which results in a reduced cross-section of the thread, or the thread may even break. Both situations are undesirable. The reduced crosssection portions in a thread reduce the quality of the fabric and the breaking of the thread in the thread brake causes a shut-down of the loom, which in turn leads to weaving faults because the thread must be tied again. Such weaving faults are especially visible in fabrics having a high proportion of weft threads of the "Lurex" ® type. The weaving faults are even worse where all the weft threads are of the Lurex ® type. As a result, the manufacture of so-called "Lurex" ® fabrics is subject to a large proportion of second quality goods. This problem can be solved only by reducing the number of shut-downs of the loom, in other words, by assuring a smooth loom run.

Another problem encountered in the use of Lurex ® yarns as weft threads of a woven fabric, is caused by the high elasticity of such yarns or threads. Even a small retarding of such threads as they are being pulled over the flange of the disk supply spool, causes such a stretching that a change in the finished fabric becomes noticeable, for example, in the form of a so-called thin spot or in the form of color variations. These fabric faults can even be caused when the thread is taken out of a thread layer directly in contact with the flange of the spool. These faults can also occur when a loop in the thread causes a temporary snagging of the thread advance in the thread brake.

The above discussed problems become more and more pronounced as the quantity of thread on the supply spool is being reduced in the course of the weaving process. Stated differently, the smaller the diameter of the thread supply on the supply spool, the more layers must be pulled off per unit of time so that the unwinding r.p.m. of the thread being pulled off the supply spool increases. Thus, loop formations, snagging, and thread breaking increase as the quantity of thread on the supply spool decreases. The effects are directly visible as weaving faults in the fabric. These faults reduce the quality of the goods, resulting in "seconds".

The overall appearance of a Lurex ® fabric is also greatly affected by so-called "rotation points" which are caused by the overhead withdrawal of the Lurex ® weft thread from the supply spool. In order to avoid all the above mentioned problems it is highly desirable that Lurex ® weft threads can be withdrawn from their supply spool substantially without any twisting.

Permitting the supply spool to freely rotate in response to pulling the weft thread off in the axial direction, rather than pulling it off a stationary supply spool, has also not solved the above problems, because the synchronization of the rotation of the supply spool with the rotation of an intermediate weft thread storage device is virtually impossible, especially in high speed looms where the acceleration and deceleration of the supply spool cannot be controlled by simply pulling off the weft thread from a freely rotatable supply spool.

Even where the pulling-off direction or unwinding is perpendicular to the rotational direction of the supply spool, the above mentioned problems could not be solved heretofore because of synchronization problems between the spool drive or rotation and the drawing or pulling-off. Accordingly, heretofore, the fine control of the pulled-off yarn, that is necessary for the desired compensation, has not been achieved.

OBJECTS OF THE INVENTION

In view of the above it is the aim of the invention to achieve the following objects, singly or in combination:

to provide a method for a so-called overhead withdrawal of weft thread yarn from a coiled yarn or thread supply spool which will avoid the twisting of the thread or yarn when the yarns or thread is removed from the spool in an "overhead" type pulling manner;

to pull-off yarn or thread from a coiled supply spool substantially parallel to an axial direction of the spool and to positively control or drive the spool in such a manner, that the position of a take-off point where the yarn or thread separates from the yarn supply on the spool remains at least approximately stationary relative to a circumferential direction, but still movable in a direction parallel to the rotational spool axis;

to generally avoid the above problems, including the over-stretching, snagging, breaking, looping, and twisting of the weft thread or yarn;

to provide an apparatus for the withdrawal of weft thread yarns from a coiled yarn supply spool and for feeding such yarns to the weft thread insertion grippers of a loom without stretching and without twisting the yarn; and to avoid the snagging of individual windings with each other on the coiled thread supply, and also in any thread brake.

SUMMARY OF THE INVENTION

According to the invention thread or yarn is supplied to a thread user, such as the weft thread insertion means in a shuttleless loom, by pulling the thread off a coiled thread supply spool with a given pulling speed, thereby establishing a take-off point between the thread and the coiled thread supply where the thread separates from the coiled thread supply. The coiled thread supply spool is positively rotated and so controlled that the thread supply rotates approximately in synchronism with the pulling speed or unwinding in such a manner that the take-off point remains approximately stationary relative to a center of rotation of the coiled thread supply or that it even does not move at all, except axially.

The present teaching positively avoids the above mentioned twisting of the thread or yarn even if it is drawn off the thread supply spool in the overhead fashion. This is accomplished by positively driving the thread supply spool, such as a flange or disk spool, substantially with the same r.p.m. at which the thread is reeled off the supply spool if the latter were stationary. Ideally, the thread should be pulled off the supply spool so that the thread r.p.m. is zero and the take-off point is stationary, for example, anywhere around the supply spool, but still movable in an axial direction. In other words, the take-off point does not travel around the spool. For an overhead thread pulling the take-off point would, for example, be located directly vertically above the rotational axis of the supply spool. The spool is driven in a direction opposite to the unwinding direction. Assuming, for example, that the take-off or unwinding direction of the thread is clockwise, then the invention teaches to positively drive the supply spool counterclockwise at such a speed that the take-off point remains stationary or at lest approximately stationary circumferentially.

The synchronization between the take-off r.p.m., so to speak, and the counter-rotating r.p.m. of the supply spool, can be achieved in several different ways. In one embodiment, the flange or disk supply spool and the coiled winding of thread on the spool, are sensed or scanned in a contactless manner to ascertain the respective r.p.m. The resulting signals are supplied to a microprocessor which in turn supplies control signals to a drive control so that it is assured that the r.p.m. of the supply spool tracks the r.p.m. of the thread withdrawal in response to the thread withdrawal. In other words, as the withdrawal r.p.m. increases because the supply on a spool decreases, the r.p.m. of the supply spool itself also increases correspondingly. These features make sure that the undesirable twisting is avoided.

In order to also avoid the above mentioned stretching, a thread brake is arranged, according to the invention, downstream of the supply spool as viewed in the thread withdrawing direction. The thread brake is driven in synchronism with an intermediate thread storage device. The rotational direction of the thread brake is such that it counteracts any twisting direction of the yarn. The storage device is arranged downstream of the brake.

In connection with the use of thread supply spools having a relatively large weight or having a certain unbalance, so that large revolutions per minute are not permissible, the invention provides an electrical control signal for an electrical drive control in response to the r.p.m. of the thread brake for varying the r.p.m. of the supply spool in such a manner that the r.p.m. of the supply spool can be reduced by the r.p.m. of the thread brake. A further thread brake may be arranged according to the invention at the outlet end of the intermediate thread storage device. The further thread brake is also driven in a rotational direction which opposes the twisting direction or tendency of the yarn. Thus, the further thread brake rotates in a direction opposite to the rotational direction of the intermediate thread storing device, or rather of the rotational portion of the intermediate thread storage device in order to compensate for any twist that could have been applied to the thread in the intermediate thread storage device.

It has been found that the above mentioned over-stretching of the threads can be positively avoided by increasing the diameter of the spool flange on the withdrawal side of the supply spool. This feature makes sure that the thread is not pulled-off at an acute angle from the supply spool. Angles of about 2° to 5° between the thread direction and the longitudinal axis of the supply spool should be avoided. By increasing the diameter of the spool flange on the withdrawal side, the angle is increased to about 40° to 60°, whereby the thread separation from the coil or winding is substantially improved without applying undesirable tension stress to the thread. Another advantage of the enlarged flange diameter on the withdrawal side results from the fact that the thread is exposed to a centrifugal force which tends to pull the thread in an approximately radial direction away from the coil or winding, thereby also facilitating the separation of the thread from the coil or winding. As a result, the thread can be easily pulled off the supply coil without any snagging of one thread winding of yarn relative to another, thereby avoiding the above mentioned undesirable over-stretching and thread breaking. Incidentally, the flange or separate disk of increased diameter may either be stationary or it may rotate with the supply spool.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figures 1, 2:
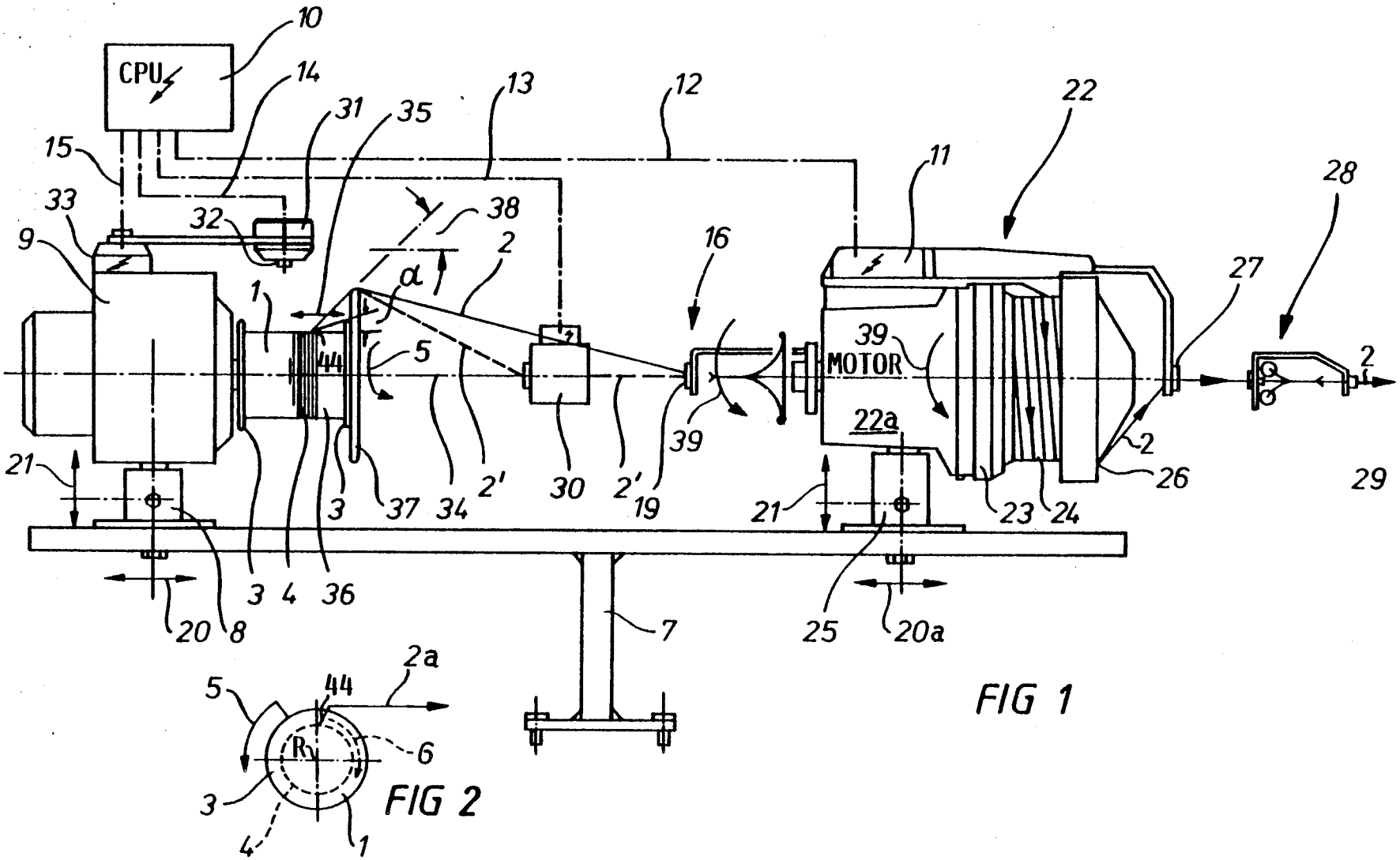
FIG. 1 is a schematic side view of a first embodiment of the invention, and showing additional features not necessarily part of the invention.
FIG. 2 illustrates schematically the pulling off of the thread from the coiled thread supply.

FIG. 1 shows a flange or disk spool 1 carrying a coiled winding 4 of thread 2 wound onto a spool core 36 having end flanges or disks 3. According to the invention the supply spool is driven by a motor 9 mounted on a footing 8 secured to a table 7. The footing 8 is adjustable in its position relative to the table 7, whereby the position of the motor 9 is also adjustable vertically up and down as indicated by the arrow 21 and horizontally back and forth as indicated by the arrow 20.

A motor control 33 is responsive to a central processing unit 10 through an electrical conductor 15. The central processing unit 10 in turn is connected through an electrical conductor 14 to a sensor 31 having a sensing head 32, for example, an optical sensing head for scanning the supply spool 1. The sensing head 32 provides to the central processing unit 10, a signal that is characteristic for the instantaneous status of the thread removing or pulling off operation.

According to FIG. 2, the thread 2 is pulled off from the supply spool 1 in the direction indicated by the arrow head 2*a*. The initial winding direction of the thread onto the supply spool 1 is indicated by the arrow 6. The above mentioned thread take-off point 44 forms where the thread 2 separates from the winding 4. When the spool 1 is stationary, and the thread 2 is pulled off the spool 1, the take-off point 44 travels around the winding 4 in a direction opposite to the original winding direction as indicated by the arrow.5. However, according to the invention, the spool 1 is positively driven in response to control signals to be described in more detail below, and the rotational direction of the driven spool is again in the original winding direction 6, whereby the travelling of the take-off point 44 can be compensated to such an extent that the take-off point 44 remains approximately or even completely stationary relative to a center of rotation R of the spool 1. This feature of the invention avoids with certainty the twisting of the thread 2 because each revolution of the take-off point 44 is compensated by a respective counterrevolution of the spool 1. Axial movement 35 is not affected thereby.

FIG. 1 shows that, according to the invention, the spool 1 is equipped with an enlarged end disk 37 having a diameter larger than the neighboring end flange 3. This larger diameter of the disk 37 avoids a very acute pulling-off angle $\alpha$ of the thread 2 as will be described in more detail below. The construction may be such that the disk 37 either rotates with the spool 1 or it may be stationary even if the spool 1 rotates.

As shown in FIG. 1, without the enlarged diameter disk 37, the pull-off angle $\alpha$ is undesirable acute which promotes snagging of the thread 2 at the take-off point 44 with neighboring turns of the winding still on the spool 1. The enlarged diameter of the disk 37 substantially increases the take-off angle as shown at 38 to a range of about 40° to about 60°, whereby snagging and thread breaks are substantially avoided. Incidentally, the angle $\alpha$ is measured between the thread direction and the horizontal axis 34 or a line parallel to axis 34.

Another advantage of the enlarged diameter disk 37 is seen in the fact that the centrifugal forces effective on the thread 2 are increased so that an improved pull is applied to the thread in a direction which facilitates the thread take-off, thereby avoiding snagging. This feature is especially effective and advantageous when the take-off point 44 is close to the inner surface of the flange 3.

Downstream of the disk 37 as viewed in the feed advance direction of the tread 2, the latter is directed again toward the horizontal axis 34 and toward a guide eye 19 of a conventional thread brake 16 leading the thread 2 into an intermediate thread storage device 22 having a cylinder spool 24 for holding a certain quantity of thread in a temporary or transitionary storage. The conventional thread brake 16 is needed only if the intermediate thread storage device 22 is used. In instances where an intermediate thread storage is not necessary, only one conventional thread brake 28 will be used. Downstream of the thread brake 28 the thread 2 travels in the direction of the arrow 29 toward a thread user, such as the weft thread insertion grippers of a shuttleless loom, not shown.

In the example embodiment shown in FIGS. 1 and 2 both conventional thread brakes 16 and 28 are used, whereby the brake 16 maintains the proper tension on the thread 2 upstream of the intermediate thread storage 22, while the brake 28 maintains the proper tension downstream of the storage 22 for the proper weft thread insertion.

The intermediate thread storage device 22 as such is conventional, it comprises a housing 22*a* holding its own motor for driving a rotor 23 in the direction of the arrow 39. The rotor 23 carries the cylinder spool 24 for the temporary storage of a certain quantity of thread which is removed from the cylinder spool 24 through a thread pull-off 26. The thread 2 then is guided through a guide eye 27 toward the thread brake 28. A control 11 for the motor of the intermediate thread storage 22 is connected through an electrical conductor 12 to the central processing unit 10. The housing 22*a* is mounted on a support 25 which in turn is adjustably secured to the table 7 for a vertical adjustment as indicated by the arrow 21*a* and for a horizontal adjustment as indicated by the arrow 20*a*.

Figure 3A:
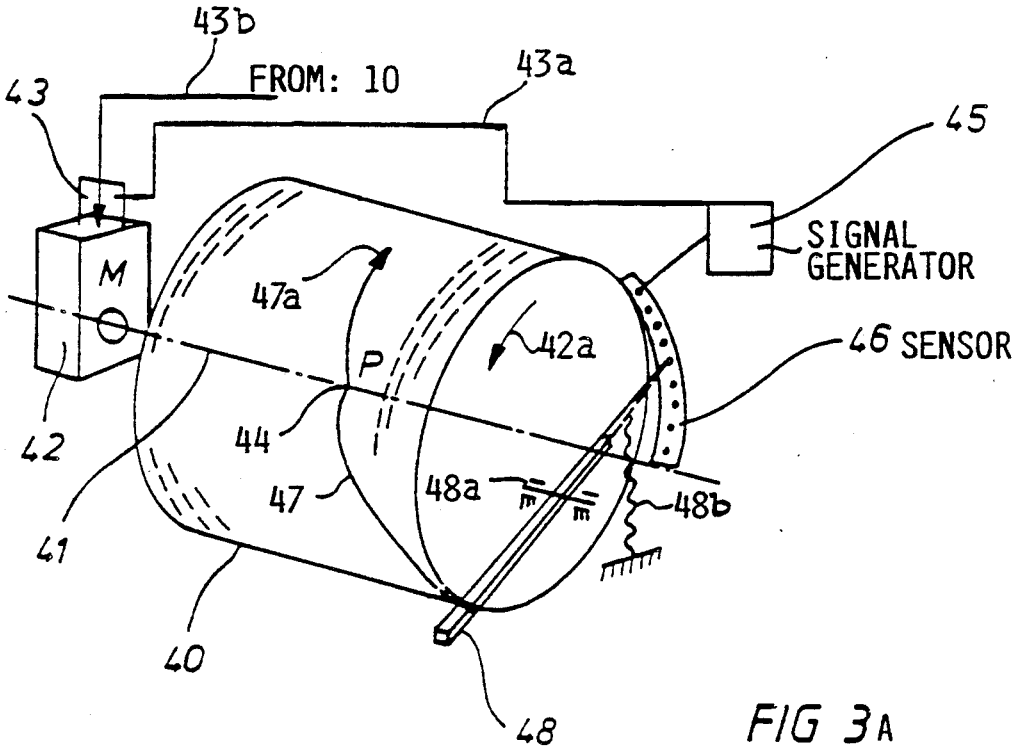
FIGS. 3A and 3B illustrate schematically, and in perspective views, two arrangements of a sensor arm for scanning the diameter of a rotatably driven supply spool by contacting the spool with the senor arm.
Figure 3B:
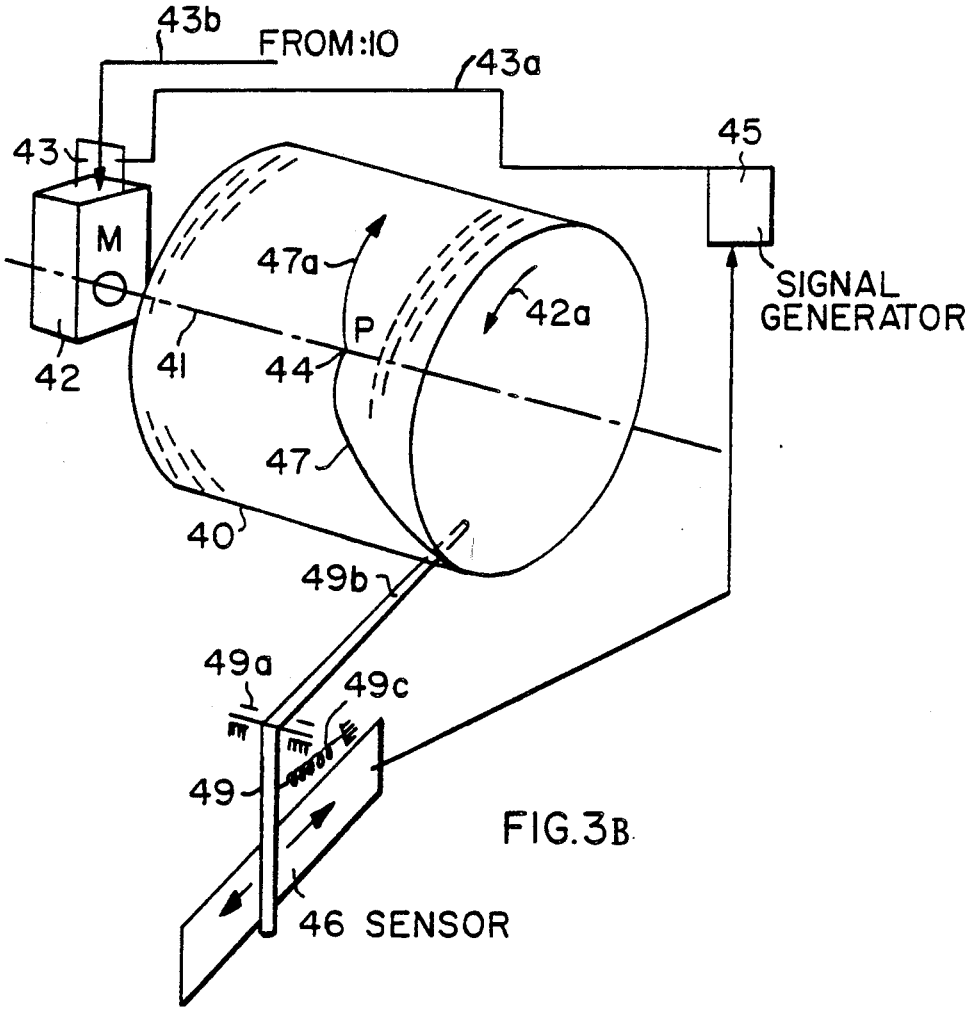

FIGS. 3A and 3B show modified embodiments with a supply spool 40 similar to the spool 1 of FIG. 1. The spool 40 is driven by a motor 42 in the direction of the arrow 42*a* about a rotational axis 41. The rotational direction 42*a* corresponds to the original winding direction and is opposite to the unwinding direction 47*a* of a thread 47 which separates from the winding on the spool 40 at the take-off point 44. The motor 42 is controlled by a motor control 43 connected by an electrical conductor 43*a* to a control signal generator 45 responsive to a sensor or scanner 46 which senses the quantity of thread still left on the supply spool 40, for example, in an optical, electrical, or electronic manner. In FIG. 3A the sensor or scanner 46 cooperates with a sensing arm 48 that is journalled on a journal axis 48*a* and biased by a spring 48*b*. The arm 48 has a tip cooperating with the sensor 46 and the tilted position of the arm 48 will depend on the quantity of thread still on the spool 40. The more thread is being removed from the spool 40 the faster the spool 40 will have to move to maintain the take-off point 44 stationary because the take-off speed must increase when the diameter of the winding on the spool 40 becomes smaller in order to maintain the thread withdrawal speed constant. Thus, the motor 42 in response to the control signal from the signal generator 45 will track, so to speak, the r.p.m. of the spool 40 in response to the quantity of thread still left on the spool for the desired compensation to keep the take-off point 44 substantially stationary relative tot he rotational motions just described. The point 44 will travel back and fourth along a line extending in parallel to the rotational axis 41.

In FIG. 3B, the arm 48 for sensing the remaining diameter of the winding on the spool 40, has been replaced by a sensor arm 49 journalled to an axis 49*a* arranged outside the spool 40. The sensor arm 49 also cooperates with a sensor 46 connected to the signal generator 45. The sensor arm extension 49*b* contacts the outer surface of thread windings on the spool 40 under the bias of a spring 49*c*. The function is the same as that in dashed lines in FIG. 3. The function is the same as that of the sensor arm 48 in FIG. 3A. In both instances, the motor control 43 compares a reference signal from the central processing unit 10 with a signal generated by the signal generator 45 in response to the sensor 46. If the two signals match, the rotation of the spool 40 may remain constant. If there is a deviation in one or the other direction, the speed of the spool will be increased or decreased as required.

Figure 4:
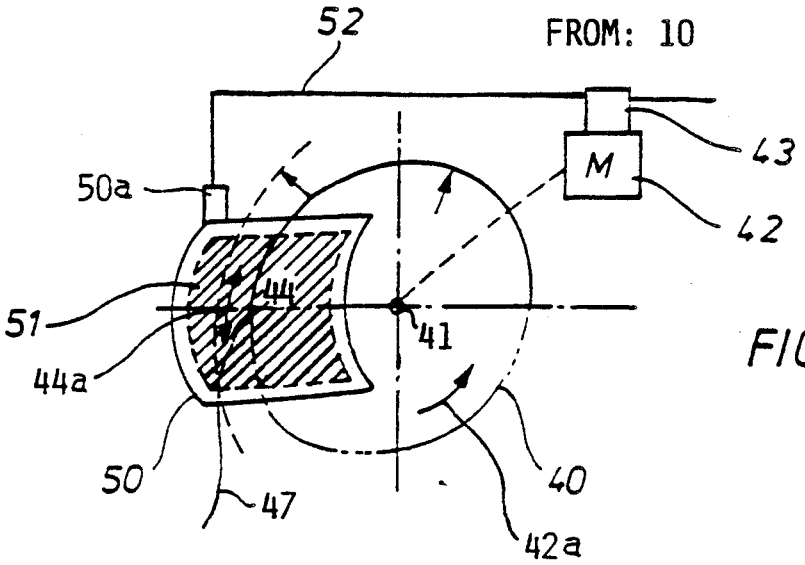
FIG. 4 is a schematic illustration of the arrangement of a scanner facing the supply spool to provide a contactless scanning in combination with a tracking control of the drive motor for the supply spool.

FIG. 4 illustrates an embodiment with a scanner 50 having a sensor or scanning surface area 51 facing the entire circumferential surface of the spool 40. The sensor 50 also determines the instantaneous diameter of the supply of yarn still remaining on the spool 40. Additionally, the sensor 50 monitors the position, or rather the movement 44*a* of the take-off point 44. Without the compensation according to the invention, the take-off point 44 would tend to move up and down, or all around a stationary supply spool. However, the motion 44*a* is sensed by the sensor zone 51 of the scanner 50, whereby a signal generator 50*a* generates a respective control signal that is supplied through an electrical conductor 52 to the motor control 43 which again compares the signal with a signal from the central processing unit to provide a control signal for the motor 42 which rotates the spool 40 in the direction of the arrow 42*a* to obtain the above mentioned compensation so that again the takeoff point 44 is maintained approximately stationary or even completely stationary.

In all instances of the scanning or sensing it is merely required that the rotational speed of the supply spool or the diameter change of the supply spool 40, or also the pull-off speed of the thread 47 or the like is sensed in order to provide with the thus produced signal through the signal generator, for example, the signal generator 45 of FIG. 3, the follow-up control of the control 43, whereby the motor 42 is tracked. The tracking through the motor 42 takes place in such a manner that during pulling-off the thread 47 the thread spool is rotated in a direction opposite to the unwinding direction so that the take-off point 44 according to FIG. 3 on the circumference of the supply spool 40 comes to a standstill.

The motion characteristic or tendency of the take-off point 44 may be derived from various features, such as the ratio of the average coil diameter of the thread on the spool 1 or 40 to the diameter of the thread coil stored on the intermediate storage cylinder spool 24, the length of thread in the intermediate storage, the travelling direction of the take-off point 44, the extent of excursions of the take-off point 44 from a central position, etc. Signals representing these features are combined with signals from the central processing unit in accordance with control programs stored in the CPU 10, for a proper control of the rotation of the supply spool 1, 40 as taught herein.

FIG. 1 also shows a thread twist sensor 30 arranged between the spool 1 and the guide eye 19 leading a thread 2' into the tread brake 28. The twist sensor 30 ascertains a twist remaining in the tread 2', e.g. by an optical sensor in a contactless manner and supplies a respective signal through a conductor 13 to the central processing unit 10 which accordingly modifies its control signal to the motor 9 of the spool 1. Thus, any twist that may still be in the thread after it has been pulled off the spool 1, may be taken into account for the control of the motor 9 to keep the take-off point 44 at least approximately stationary in the circumferential direction of the spool.

Although the invention has been described with reference to specific example embodiments, it will be appreciated, that it is intended to cover all modifications and equivalents with the scope of the appended claims.

What I claim is:

1. An apparatus for delivering thread to a thread user, comprising thread supply means including a thread supply spool (1) for providing thread that separates from said thread supply spool at a take-off point (44), spool drive means (9) for positively driving said thread supply spool (1), sensor means (32, 48, 49) for sensing an instantaneous location of said take-off point to provide a control signal representing a motion characteristic of said take-off point, and drive control means (10) responsive to said sensor means for controlling the operation of said spool drive means so that motions of said take-off point are minimized or reduced to zero in a circumferential direction while still permitting radial and axial movements of said take-off point.

2. The apparatus of claim 1, wherein said sensor means determine a motion extend and/or motion direction of said take-off point (44) as said motion characteristic for controlling said spool drive means by imposing a positive rotation to said coiled thread supply spool to compensate for any excursions of said take-off point.

3. The apparatus of claim 1, further comprising intermediate thread storage means (24) arranged approximately coaxially with said coiled thread supply spool (1), further drive means (22) for said intermediate thread storage means (24), further drive control means (11) for controlling said further drive means (22) in response to thread use-up representing signals, said first mentioned drive control means (10) providing unwinding drive signals to said spool drive means (9), and means interconnecting said first mentioned drive control means (10) and said further drive control means (11) for producing said unwinding drive signals in response to said thread use-up representing signals.

4. The apparatus of claim 1, wherein said drive control means comprise a central processor (10) and a synchronizing signal generator (45) responsive to at least one thread supply characteristic for providing reeling-off signals to said drive control means (10) in response to winding signals from said sensor means and in response to synchronizing signals from said signal generator (45), in such a way that said take-off point (44) remains approximately stationary in a tangential direction relative to a rotational center.

5. The apparatus of claim 4, wherein said sensor means comprise a sensor (46, 48; 46, 49) connected to said signal generator (45) for providing said synchronizing signals, said sensor ascertaining an instantaneous or average diameter of a winding (4) on said thread supply spool (40).

6. The apparatus of claim 1, wherein said thread supply spool comprises a disk spool having an increased diameter disk (37) next to a flange on a pull-off side of said disk spool, said increased diameter being so dimensioned that a thread take-off angle is within the range of about 40° to about 60°.

7. The apparatus of claim 6, wherein said increased diameter disk is constructed to rotate with said disk spool.

8. The apparatus of claim 6, wherein said increased diameter disk is freely rotatable independently of said disk spool.

9. The apparatus of claim 6, wherein the disk spool with its motor (9) is mounted on a machine mounting (8) which is adjustable horizontally and vertically relative to a support (7).

10. The apparatus of claim 6, further comprising a twist sensor (30) arranged for cooperation with said disk spool and downstream of said disk spool as viewed in the travel direction of the thread, for ascertaining a twisting of said thread by optical means in a contactless manner, and means (13) operatively connecting said twist sensor to said drive control means for providing a control signal for driving said disk spool to keep said take-off point (44) at least approximately stationary in the circumferential direction.

11. A method for avoiding twisting of a thread as the thread is being pulled off a thread supply spool, comprising the following steps:

(a) driving said thread supply spool by an electric motor with a controllable speed, (b) sensing the quantity of thread still left on said thread supply spool for providing a respective quantity signal, (c) producing an electrical motor control signal from said quantity signal, and (d) controlling said electric motor by said motor control signal so that a take-off point (44) where said thread leaves said thread supply spool remains approximately stationary in a tangential direction relative to a center of rotation of said thread supply spool, while still permitting an axial and radial movement of said take-off point (44).

12. The method of claim 11, wherein said sensing is performed in a contactless manner by a sensor (32) facing said spool.

13. The method of claim 11, wherein said sensing is performed by a sensor (48, 49) contacting the surface of said thread supply spool.

14. The method of claim 11, wherein said thread supply spool is driven during take-off of thread in a direction corresponding to an original winding direction of thread onto said spool for keeping said take-off point (44) substantially stationary in a tangential direction on said thread supply spool.

15. The method of claim 11, further comprising modifying said motor control signal in a central processing unit (10) in accordance with a control program.

16. The method of claim 11, further comprising pulling said thread at a pull-off angle to an axial direction of said thread supply spool, and maintaining said pull-off angle within the range of about 40° to about 60°.

* * * * *